United States Patent [19]

Wise

[11] 4,013,319

[45] Mar. 22, 1977

[54] TUNNELING MACHINE WITH MASSIVE GUIDE FOR IMPACT TOOLS

[75] Inventor: Boyd A. Wise, Webster, N.Y.

[73] Assignee: Hydroacoustics Inc., Rochester, N.Y.

[22] Filed: Mar. 20, 1975

[21] Appl. No.: 560,271

[52] U.S. Cl. ..... 299/31; 173/52; 175/96; 175/108; 299/15; 299/62

[51] Int. Cl.[2] ..... E21D 9/08

[58] Field of Search ..... 299/31, 33, 62, 69, 299/70, 13, 15, 38; 173/52; 175/96, 108

[56] References Cited

UNITED STATES PATENTS

| | | | |
|---|---|---|---|
| 127,125 | 5/1872 | Von Schmidt | 299/13 X |
| 1,206,288 | 11/1916 | Ball | 299/38 |
| 2,675,996 | 4/1954 | Gunning | 173/52 X |
| 3,314,725 | 4/1967 | Tinlin | 299/62 |
| 3,784,257 | 1/1974 | Lauber et al. | 299/31 |

FOREIGN PATENTS OR APPLICATIONS

| | | | |
|---|---|---|---|
| 164,230 | 12/1901 | Germany | 173/52 |

*Primary Examiner*—Ernest R. Purser
*Attorney, Agent, or Firm*—Martin LuKacher

[57] ABSTRACT

A tunneling machine is described which uses an array of impact tools for cutting a deep kerf that defines the wall of the tunnel. The impact tool provides impact blows through drill steels to which drill bits are attached. A substantial portion of the drill steels extend through webs which provide bearing support and alignment for the drill steels and bits on a dynamic basis while the kerf is being cut and the webs also permit the drill steel to bend; thus providing clearance between the impact tool and the wall of the tunnel. The webs also provide control of the sideways motion of the bit, while at the same time, providing for full impact blows to be delivered to the working face.

32 Claims, 17 Drawing Figures

ON-AXIS BIT FORCE vs TIME

TUNNELING MACHINE WITH MASSIVE GUIDE FOR IMPACT TOOLS

The present invention relates to tunneling machines and particularly to machines for excavating by cutting deep kerfs in earth formations.

The invention is especially suitable for use in machines for excavating large diameter tunnels, say 10 to 30 feet in diameter where the excavation is to be made into hard rock formations. Other aspects of the invention are generally applicable to earth boring, excavating, and kerfing.

The tunnel bores which are presently being used to cut large tunnels into hard rock have large rotatable cutting heads which grind the entire face of the tunnel. Since the entire face is broken into chips, enormous amounts of power are required in such machines and boring is very slow under hard rock conditions, say only a few feet per hour. Moreover, since tremendous static thrusts must be applied to the walls of the tunnel in order to support the huge forward thrusts applied to the cutting face, care must be taken to insure that the side walls are not crushed and that the tunnel does not collapse upon the machine.

Another technique for tunneling which has been used for some time requires arrays of rock drills for drilling patterns of blast holes into the tunnel face. Explosives are then used to cave in the face of the tunnel. Since explosives rarely produce a smooth, strong wall surface, additional labor and material are required for finishing operations. Of course, extreme precautions must be taken to provide safety when using the explosives.

Notwithstanding that impact drilling is more efficient than boring with mechanical borers of the type described above, especially when hydroacoustic impact tools of the type described in U.S. Pat. Nos. 3,371,726 and 3,382,932, are used, no practical applications of such impact tools in tunneling has been provided, except for their use in drilling blast holes.

Even though it was as far back as 1866 (see U.S. Pat. No. 55,514, issued June 12, 1866) that a method of tunneling had been proposed using impact tools to cut a kerf which outlined the wall of the tunnel, this method had not gone into practical use. Over the years since 1866, various machines and methods for tunneling by kerf cutting with impact tools have been suggested, (see U.S. Pats. Nos. 1,032,049, issued July 9, 1912; 1,163,859, issued Dec. 14, 1915; 1,212,107, issued Jan. 9, 1917; 1,580,001, issued Apr. 6, 1926; 1,851,037, issued Mar. 29, 1932; 2,398,311, issued Apr. 9, 1946; 3,007,686, issued Nov. 7, 1961; and 3,314,724, issued Apr. 18, 1967). All of these proposals to the contrary notwithstanding, no practical tunneling machines which use impact tools to cut kerfs so as to form the tunnel walls are in commercial use at the present time.

It has been found in accordance with this invention that kerfing of deep kerfs, say 10 feet in depth, can be accomplished, if the drill steel of the impact tool is supported within the kerf of a bearing structure which maintains the alignment of the drill steel and bit attached thereto, and controls the motion of the steel and bit on a dynamic basis. Moreover, the alignment of the drill steel within the kerk permits the actuator of the tool to be spaced from the tunnel wall with sufficient clearance to permit the kerf to be cut at substantially the exact tunnel diameter which is desired. In other words, with the drill steel supported in the kerf, a section of the drill steel can be maintained in bent condition thus allowing the actuator to clear the tunnel wall.

Once the kerf is cut, the impact tool may be used in the usual way as rock drills, or may be used to cut longitudinal kerfs whereby to permit the core remaining after the kerf is cut to fall apart into chunks by its own weight or to be blasted apart, but with charges of much smaller explosive force than have heretofore been required in the blast-hole method of tunneling. Sections of rock in the core can also be failed in tension by inserting hydraulic jacks in the kerfs, thus eliminating the use of explosives entirely.

In accordance with another feature of the invention, steering (viz., excavating tunnels along different headings) may be provided by cutting sections of kerf at angles to the axis of the tunnel. After the partial core is removed, a new heading is defined, along which new kerfs can be cut.

Accordingly, it is an object of the present invention to provide improved apparatus for cutting kerfs in earth formations.

It is a further object of the invention to provide improved machines for excavating tunnels which employ impact tools for cutting deep kerfs to outline the walls of the tunnel.

It is a still further object of the present invention to provide improved tunneling machines which facilitate the cutting of tunnels at faster rates than heretofore practicable.

It is a still further object of the present invention to provide an improved machine whereby the amount of useful power applied to excavating the tunnel may be increased.

It is a still further object of the present invention to provide an improved tunneling machine which is more efficient in operation than tunneling machines which have heretofore been provided, such as tunnel boring moles.

Briefly described, the invention when embodied in an apparatus for cutting a kerf in an earth formation includes an impact tool having a drill steel and a bit at the end of the steel for delivering mechanical impact power to the formation. A carriage supports the tool and also supports at the forward end of the apparatus, a web structure through which a substantial length of the drill steel extends. The bit at the end of the drill steel projects from the web structure. The drill steel extends through the web structure. When operated, the impact tool provides a succession of impact blows, while at the same time, the carriage advances the tool and the web structure into the formation. The carriage is also movable in a sideways direction so as to cut the kerf. Sideways motion may be continuous to cut a circular kerf, but in many cases will be back and forth, either to cut an arcuate segment or a straight-line kerf. The web structure both aligns the drill steel in the kerf and dynamically controls the motion of the steel. It keeps the variable load applied to the bit and the steel which accompanies each impacting event from influencing the sideways motion of the bit. Preferably, the web structure is characterized by having, in addition to adequate long-time average bearing capacity for kerf-cutting, a short-time bearing load capacity in the sideways direction equal to or greater than the maximum load force values associated with the longitudinal impact force values applied to break rock, and to further have a large enough frontal mass located close to the bit so that high-frequency translational or rotational motions of the web structure in the plane of the kerf caused either by impact events or by movement (e.g. indexing) between impact events will be small compared with the desired displacements associated with advancing the bit, as by indexing the carriage between blows. More specifically, the desired frontal mass should preferably have both a high enough mass and high enough moment of inertia that the effective mass reactance that opposes side motions of the bit has a high value with respect to the stiffness reactance defined by the force-deflection characteristic of the bit-rock combination. The requisite mass may be determined from the reactance values which depend upon the pulse frequency defined by the time duration of the repetitive force pulses generated by the impact tool. The frontal mass may be provided by portions of the web located close to the bit, say within about 1/12 of a wavelength determined using the velocity of sound propagation in the web at the pulse frequency. The web structure frontal mass thus dynamically controls side motion under impact blows and reduces chatter-type side motions when the bit is moved, as by being indexed.

The frontal mass may be provided by structures having greater dimensions than the web arrangement mentioned above and may be joined to other mass elements in the kerfing apparatus. It is desirable to avoid in such structures unwanted resonances or amplifications of motion. For example, it may be advantageous, in kerfing apparatus having a plurality of bits, to join a number of adjacent frontal mass and bit assemblies together. The web arrangement thus prevents sidewise deflection forces accompanying each impact event from causing the impact tool to vibrate, dither, or enter into resonances which could cause fatigue and breakage of the bit and the drill steel.

In a tunneling machine a plurality of impact tools are arranged in a circular pattern, on a carriage from which a bearing member in the form of a web extends in the forward direction. The carriage is rotated, say with oscillatory motion, as it is thrust into the formation. The cutting action thus provides a deep kerf equal in length to the length of the web. This kerf defines the wall of the tunnel and produces a core which may be removed by mechanical means or by explosives. When explosives are to be used, the impact tools may be advanced in the manner of normal rock drills so as to drill blast holes, while the carriage is maintained stationary in fixed position.

The foregoing and other objects and advantages of the present invention, as well as additional features thereof will become more readily apparent from a reading of the following description in connection with the accompanying drawings in which.

Figure 1:
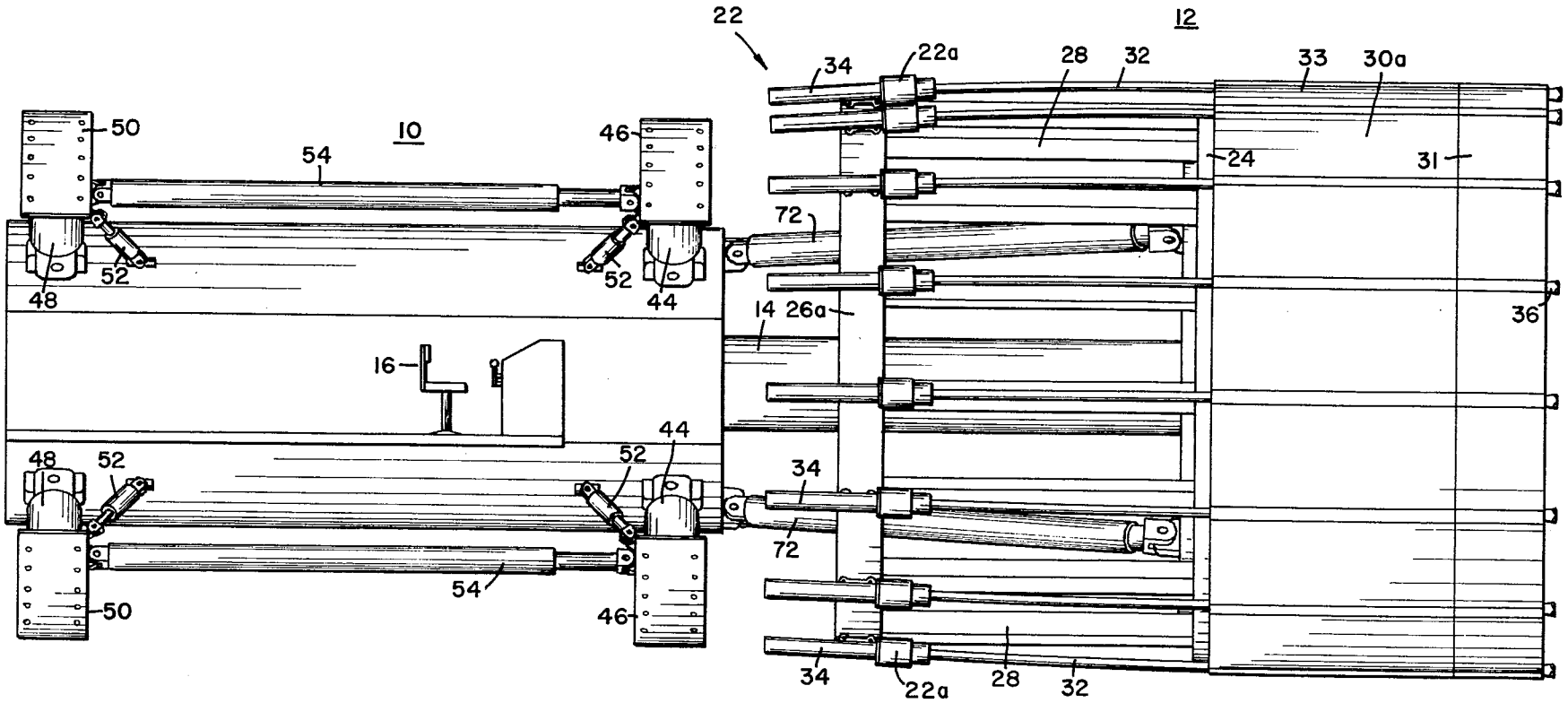
FIG. 1 is a front view of a tunneling machine embodying the invention.
Figure 3:
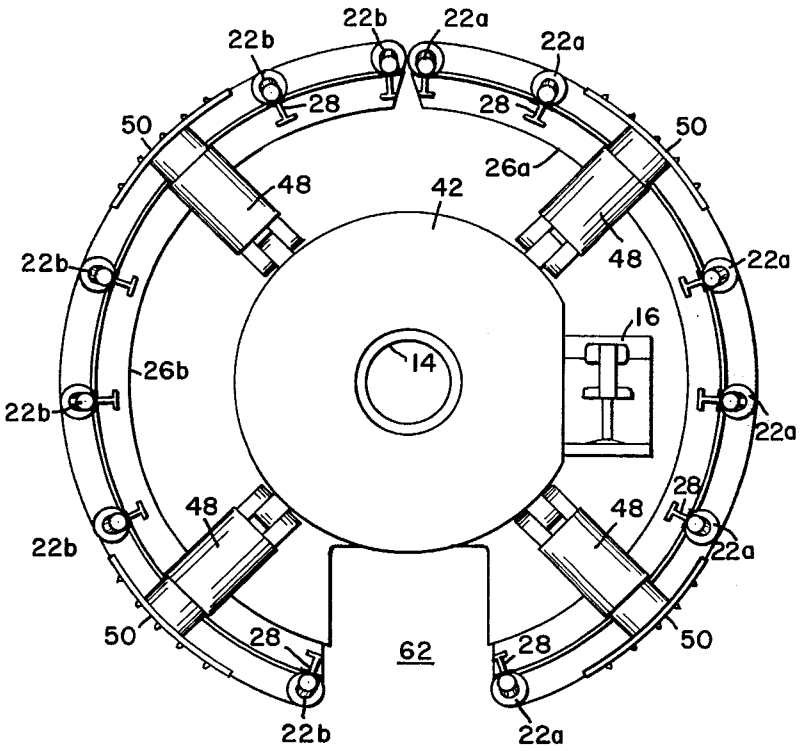
FIG. 3 is a left end view of the machine shown in FIG. 1.

Referring to FIGS. 1 to 4, there is shown a tunneling machine having a propulsion unit 10 and a cutting unit 12. The cutting unit 12 is supported from the propulsion unit by a main beam 14 which is in the form of a shaft. The relative size of the machine elements will be apparent from the operator's station 16 which is shown as containing a seat upon which the operator may be seated before a control panel.

The cutting unit provides a carriage for supporting a plurality of impact tools 22 in a circular pattern. Two groups of such tools are provided indicated as 22*a* in the first group, and 22*b* in the second group; the groups being disposed in opposite halves of the circular pattern (see FIG. 3). The carriage includes a disc-shaped member 24 centrally connected to the forward end of the shaft 14. A pair of circular frames 26*a* and 26*b* which are connected by beams 28 to the disc 24, carry the impact tools 22. A pair of web structures in the form of arcuate webs 30*a* and 30*b* extend in the forward direction from the disc 24. These webs are for the most part solid curved plates of diameter less than the diameter of the drill steels 32 of the impact tools. These webs have a frontal mass section 31 and a rear section 33. The frontal mass has bearings 35 and the rear section has, at its back end, bearings 37 (See FIG. 4). The frontal mass section 31 is thicker than the rear section 33. The operation of the frontal mass section in dynamically controlling the motion of the steel and bit is discussed more fully hereinafter in connection with FIGS. 12 and 13.

The impact tools 22, each contain an actuator 34 which may be a hydroacoustic actuator of the type described in the above-referenced U.S. Pats. Nos. 3,371,726 and 3,382,932. This actuator is a percussive device which provides high force pulses in rapid succession, say 50 to 150 pulses per second. The pulses are propagated along the drill steel 32 to drill bits 36 at the end of the steel and impact the formation. Rotation may be provided on the impact tools if desired, such rotation being illustrated in the above-reference patents.

A substantial portion, approximately one-half, of the drill steel extends through the web members 30*a* and 30*b*. The actuators 34 are disposed at an angle to the axis of the tunnel and to the main shaft or beam 14 of the machine. Thus, the actuators are spaced away from the wall of the tunnel to be cut and clear that wall. Notwithstanding the spacing of the actuators 34, the web members 30*a* and 30*b* align the drill steels to cut a straight kerf and a straight tunnel wall. To this end, the sections of the drill steels between the actuators 34 and the webs 30*a* and 30*b* bend so as to accommodate and provide for the clearance of the actuators 34 from the tunnel wall.

The web members 30*a* and 30*b* also provide the requisite bearing support, thus controlling the motion of the drill steels and bits 32 and 36 on a dynamic basis during kerf cutting operations.

Returning to the propulsion unit 10, it will be observed as having two structural elements 40 and 42. The forward element 40 has four legs 44 attached thereto in diametrically opposite pairs. These legs each have a shoe 46 for gripping the wall of the tunnel. The rear element 42 also has four legs 48 arranged in diametrically opposite pairs. Each of these legs has a gripper shoe 50 attached to the end thereof. Each of the legs 44 and 48 has a hydraulic cylinder for advancing and retracting the legs. Helper hydraulic cylinders 52 are also connected between the legs and the frame of the propulsion unit elements 40 and 42. The cutting unit 12 may be steered at an angle to the axis of the main shaft 14 by relatively raising and lowering the forward and rear legs 44 and 48.

The machine propels itself both forwardly and rearwardly like an earth worm. To move forward, the rear legs 48 are extended and tightly grip the wall of the tunnel. Hydraulic cylinders 54 react against the rear legs 48 and advance the forward element 40 along the main shaft 14. When the forward element is advanced a sufficient distance, say 10 feet, the forward legs 44 are advanced to tightly engage the tunnel walls, and with the rear legs slightly retracted, the hydraulic cylinders 54 pull and move the rear element 42 forward until it reaches the forward element 40.

A hydraulic power supply consisting of the pumps and motors 56 and hydraulic reservoirs 58 are disposed in the rear element 42 of the propulsion unit and power the system. Hydraulic lines, hoses and electrical conduits from the supply are not shown to simplify the illustration.

Returning to the cutting unit 12, it will be observed that the web members 30*a* and 30*b* are mounted on a segmental ring 60 which is part of the disc assembly 24. The ring 60 has two parts 60*a* and 60*b* which are separated from each other to define at the bottom of the machine, a clearance area 62 which provides access to the front of the machine, for mucking and other purposes (e.g., changing of the drill bits 36). The segmental rings 60*a* and 60*b* are slidably mounted on segmental ring gears 64*a* and 64*b*. Hydraulic cylinders 66*a* are connected between the ring 60*a* and the gear 64*a*. Similar hydraulic cylinders 66*b* are connected between the ring 60*b* and the gears 64*b*. When the cylinders are retracted the web 30*a* and its corresponding plurality of impact tools 22*a*, together with the frame 26*a* on which they are mounted, are retracted towards the axis of the machine. Similarly, retraction of the cylinder 66*b* will retract the corresponding impact tool 22*b* and web 30*b* and the frame 26*b* which supports the impact tools 22*b*. Such retraction facilitates steering of the machine so as to permit the kerfs to be cut and the tunnel to be excavated along any desired heading.

Oscillating drive means are provided for the webs and the impact tools 22 by means of electric motors 68*a* and 68*b* which are coupled to the segmental gears 64*a* and 64*b* through gear mechanisms 70*a* and 70*b* respectively. The gear mechanisms 70*a* may be designed to cause the webs 30*a* and their impact tools 22*a* to oscillate in a sense opposite to the webs 30*b* and their impact tools 22*b*. Such oscillation will move the bits 36 along the bottom of the kerf by distances at least three or four times as long as the inward impact and penetration distance into the bottom of the kerf. In order to advance the webs 30*a* and 30*b* and their corresponding impact tools 22*a* and 22*b* into the kerf, hydraulic thrust cylinders 72 are provided. The cylinders may be advanced continuously or indexed between rotations of the cutting unit 12. These cylinders bear against the disc assembly 24 and advance the entire cutting unit at a rate determined by the penetration rate into the formation which is being tunnelled. Accordingly, the entire web assembly 30*a* and 30*b* penetrates into the kerf with the web controlling the motion of the drill steels 32 and the drill bits, so as to prevent any resonances, dithering, or jittering, notwithstanding the sidewise oscillation of the bits and simultaneous impact action at the bottom of the kerf.

Figure 6:
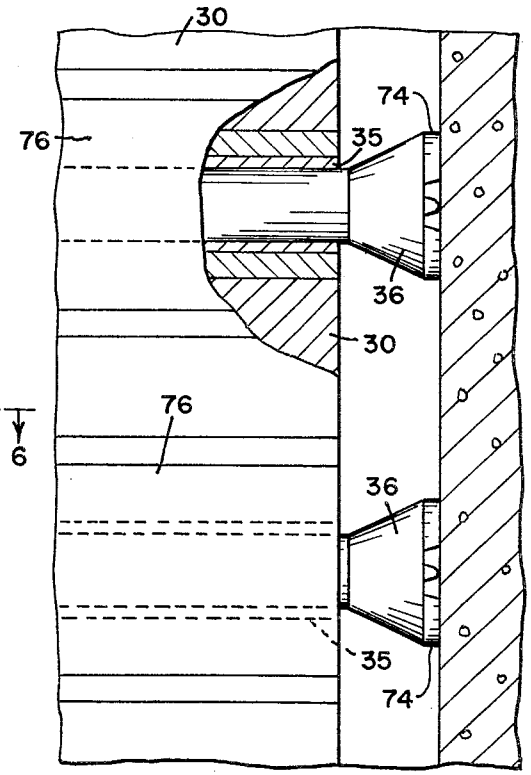
FIG. 6 is a fragmentary view, partially in sections, the view being taken along the line 6—6 in FIG. 5 and illustrating the bit shown in FIG. 5, and also the bit adjacent thereto, in process of cutting the kerf.
Figure 5:
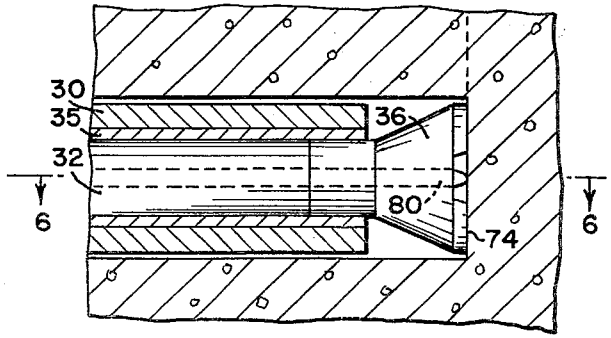
FIG. 5 is an enlarged fragmentary sectional view illustrating one of the drilling bit arrangements in the machine shown in FIG. 1, in process of cutting a kerf in an earth formation.

The cutting action will be more apparent from FIGS. 5 and 6. There the drill bit 36 is shown with the cutting teeth 74 which are arranged in this illustrative example in the form of an X. The web 30 has enlarged sections 76 containing the bearings 35 through which a subsection of the drill steels 32 extend. These bearings may be lubricated with hydraulic oil to provide hydrostatic bearings, if desired. They also may be cooled with fluid, suitably the same fluid which passes through holes 80 in the steel 32 and in the bits 36 for clearing cuttings from the bottom of the kerf.

Figure 16:
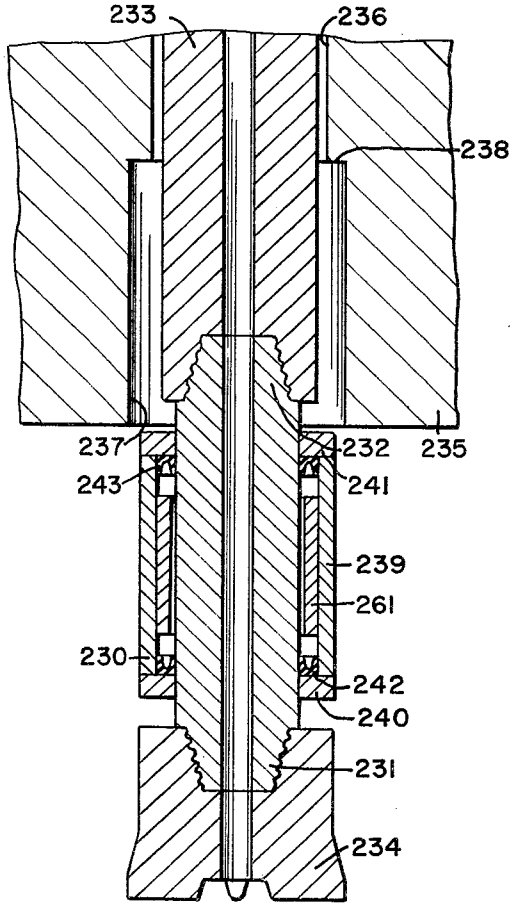
FIG. 16 is a fragmentary sectional view similar to FIG. 14 showing another bearing arrangement which permits the bit to be extended from the web and used to drill holes in the formation.
Figure 11:
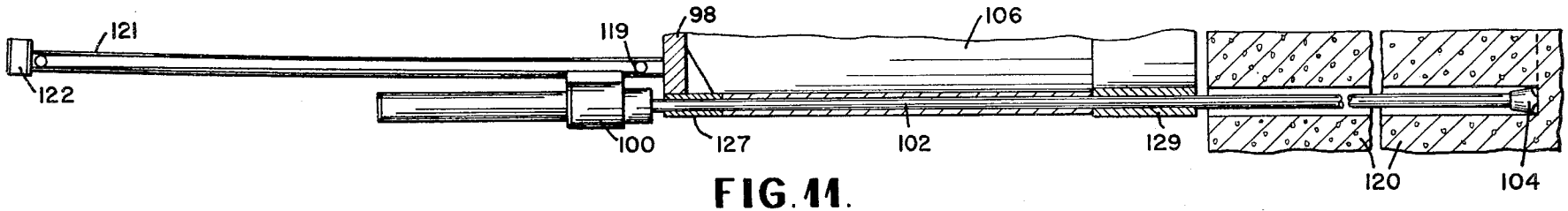
FIG. 11 is a fragmentary view showing one of the impact tools of the machine shown in FIG. 7 in process of drilling a blast hole in the face of the tunnel.
Figure 14:
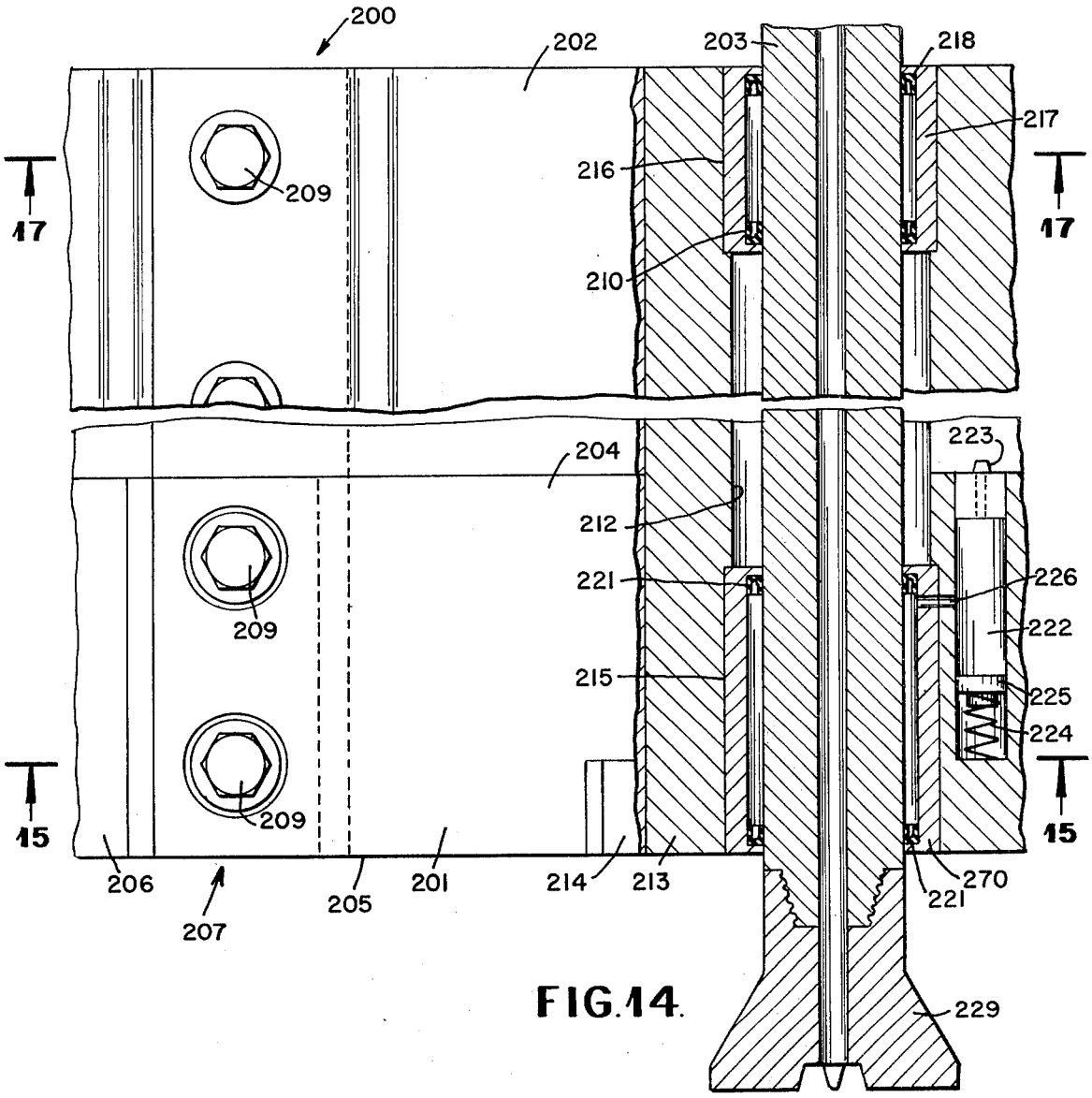
FIG. 14 is a fragmentary sectional view showing a bearing arrangement for a typical bit and its drill steel.
Figure 15:
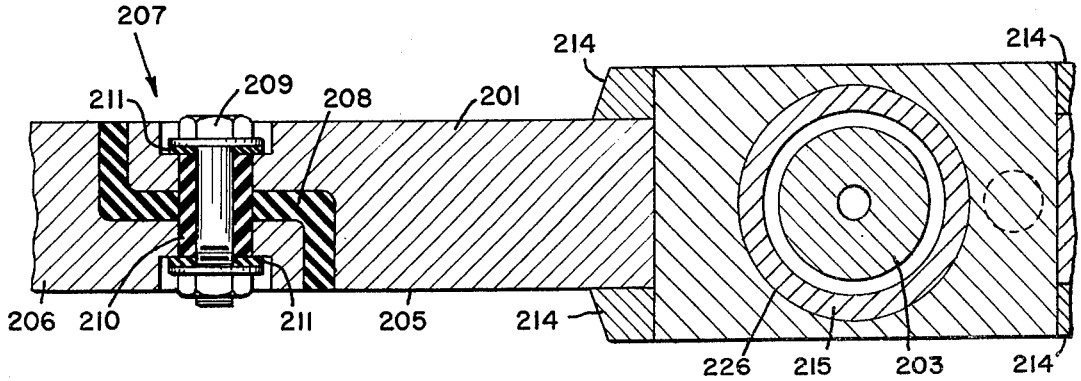
FIG. 15 is a fragmentary sectional view of the arrangement shown in FIG. 14, taken along the line 15—15 in FIG. 14.

FIGS. 14, 15 and 16 show a bit arrangement using a front bearing that uses a grease lubricant retained by seals. The use of the arrangement shown in FIG. 16 is desirable when the machine is used for both drilling and kerf cutting since the drill steel and bit can be extended out of the web for drilling operations as shown in FIG. 11. The arrangements of FIGS. 14 to 16 will be described in detail hereinafter.

The web 30 is made of steel. Since it extends approximately 180° around a circle having a diameter (say from 10 to 20 feet), it presents a massive section. This massive section also presents a high stiffness as compared to the stiffness of the drill steel and the bit, together with the portion of the formation which is penetrated by the bit. Thus, as the web, steel and bits are oscillated in the sideways direction along the bottom of the kerf, deflection of the steel and bit is controlled on a dynamic basis.

Control is accomplished by providing a mass reactance and rotary inertial reactance high enough to control the sideways bit deflection under any force likely to be applied, so that high-frequency side motions will be small compared with the motions desired to advance or cut the kerf. The criteria and equations used to determine adequate dimensions of a frontal mass are discussed below.

There are three externally applied driving forces applied to the bit, the down impulse force, the down bias force and side indexing force.

During the impulse interval, motion is dominated by the impulse force, which is at least an order of magnitude higher than the other applied forces. Side forces comparable in magnitude and duration to the downward impulse force can be controlled by means of the frontal mass arrangement provided in the web in the vicinity of the bit.

Figure 12:
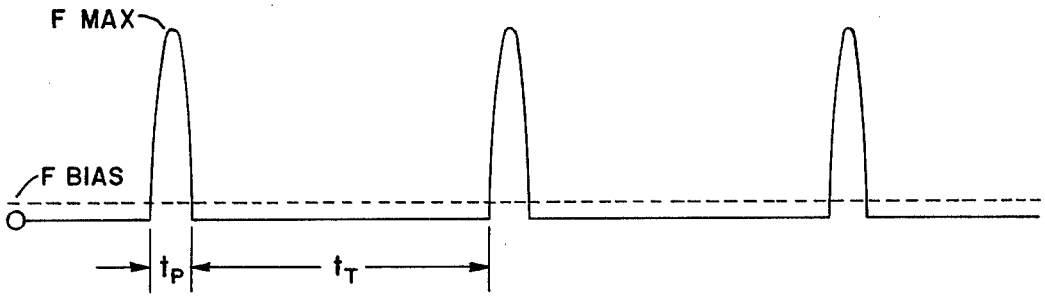
FIG. 12 is a diagram showing the waveform of the force pulses generated by a typical impact device used in the tunneling machines shown in FIGS. 1 to 11.

FIG. 12 illustrates the force pulses, as provided by one of the impact devices 22 to the steel 32 and bit 36, as having a maximum amplitude of $F_{max}$ and a duration $t_p$. The interval between pulses is $t_I$. The downward bias, as provided by the thrust cylinders 72 is shown as the $F_{bias}$ level.

Figure 13:
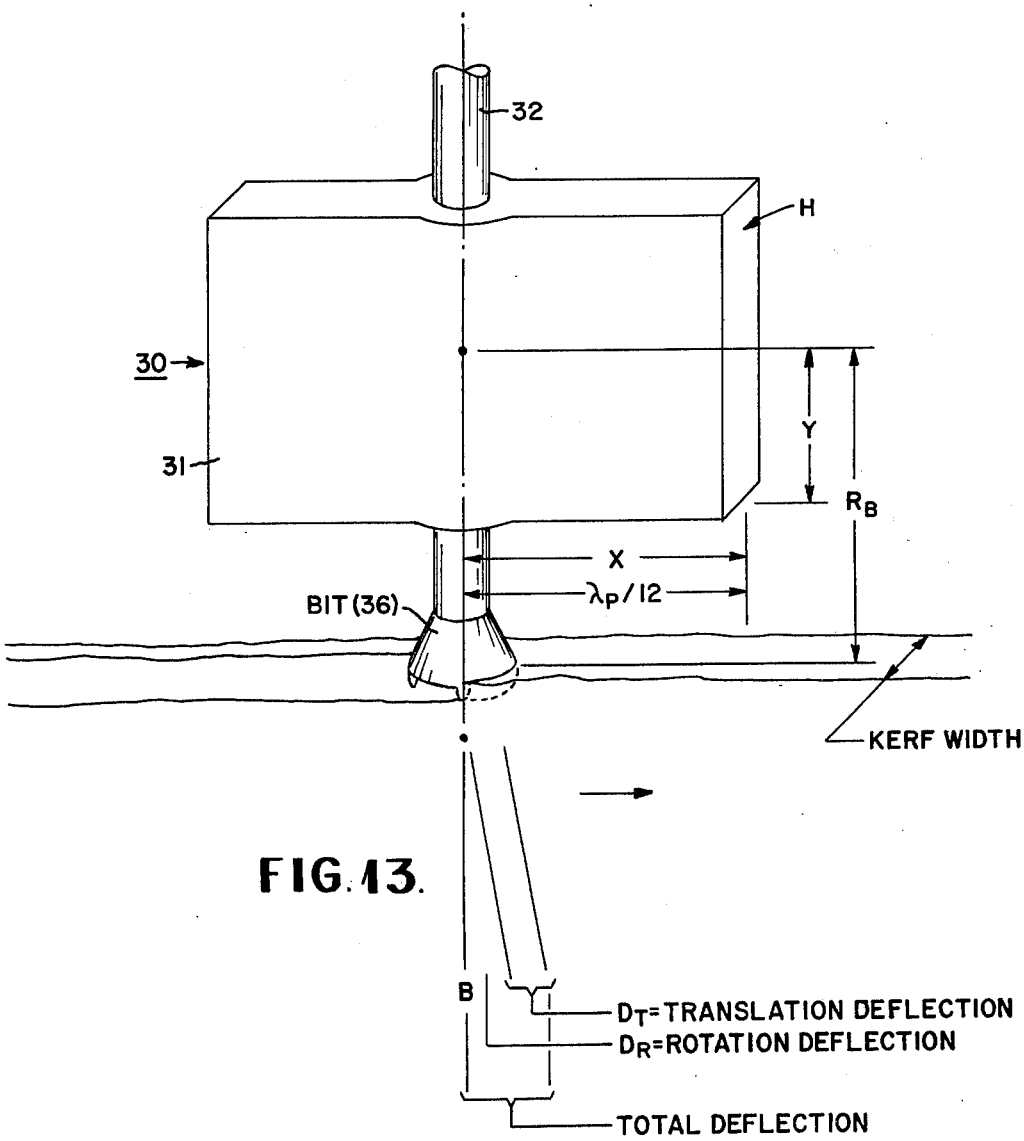
FIG. 13 is a diagram schematically illustrating the frontal mass structure for a typical kerf cutting bit used in the machines illustrated in FIGS. 1 to 11.

FIG. 13 illustrates schematically as a rectangular slab 31 the portion of web 30 which is effective in providing a frontal mass for the bit 36 and the drill steel section 32 to which the bit is connected. The preferred case where the length X in the direction of the kerf on either side of the bit is 1/12 the wavelength $\lambda_p$ at the force pulse frequency, is illustrated in FIG. 13.

During the time between impulse blows, the average side force will be less than the down bias force, but the side force will be somewhat erratic due to motion of the bit over a rough surface. Examples are discussed below for control of side forces as large as five times the magnitude of the average down bias force, with up to one-fifth of the duration of the time between impulse blows.

Consider how the side deflection during the bit force pulse is controlled. The side force to be resisted may at times approach the magnitude and duration of the force pulse applied to the bit to make rock chips. Accordingly, these magnitudes and durations are considered. A force pulse is represented as $$F = F_{max} \sin \omega_p t$$

where $$\omega_p = \frac{\pi}{t_p} = \frac{2\pi c}{\lambda p} \tag{1}$$

$t_p$ = force pulse duration, which is one half period of its corresponding sinusoidal wave
$c$ = velocity of sound in the frontal mass
$\lambda_p$ = wavelengthh of the force pulse A limiting value of side deflection during the force pulse can be determined using no damping or decelerating events, and these are the values stated below. In actual practice, damping and decelerating events will produce net deflections lower than those taken by way of this example thus further assisting in the control of bit motion.

The limiting side deflection due to translation of the frontal mass 31 which has a mass value, M, will be $$D_T = \frac{\pi F_{max}}{\omega_p^2 M} \tag{2}$$

The limiting side deflection due to rotation of the front mass will be $$D_R = \frac{\pi F_{max} R_B^2}{\omega_p^2 I} \tag{3}$$

where
$I$ = moment of inertia of frontal mass
$R_B$ = distance from bit edge to center of mass Combining the two terms above, total side deflection $D_{side}$ will be $$D_{side} = D_T + D_R = \frac{\pi F_{max}}{\omega_p^2}\left(\frac{1}{M} + \frac{R_B^2}{I}\right) \tag{4}$$

Evaluating this expression for a rectangular slab of density $\rho$, thickness H, half-width X, half-height Y, and distance from the bit to the center of mass $R_B$, as illustrated in FIG. 13 (since $$I = \frac{M}{3}(X^2 + Y^2))$$

$$D_{side} = \frac{\pi F_{max}}{\omega_p^2 M}\left(1 + \frac{3R_B^2}{X^2 + Y^2}\right) \tag{5}$$

If $R_B^2$ is equal to or less than $(X^2 + Y^2)$, which is the case for typical bits, side deflection will not exceed $$D_{side} = \frac{4\pi F_{max}}{\omega_p^2 M} \tag{6}$$

The deflection may be expressed as a fraction of the bit penetration which in turn is a function of the load stiffness and maximum applied force Let $$D_{side} = \frac{D_{bit}}{N} = \frac{F_{max}}{NK_L} \tag{7}$$

Then $$\frac{F_{max}}{NK_L} = \frac{4\pi F_{max}}{\omega_p^2 M} \tag{8}$$

And the corresponding front mass is $$M = \frac{4\pi N K_L}{\omega_p^2} = \rho \cdot H \cdot X \cdot Y \tag{9}$$

To further clarify the required thickness H, a special geometry may be examined in which X and Y are related to each other and to the wavelength at the pulse frequency. In the arrangement illustrated in FIG. 13

$$X = 2\ Y = \frac{\tau p}{12} \tag{10}$$

This configuration puts all parts of the frontal mass close enough to the bit to be effective during time intervals as short as the impact pulse interval. Using these relationships, the thickness H of the front mass can be found to be $$H = \frac{4\pi N K_L}{\omega_p^2 \rho XY} = \frac{288\ NK_L}{\pi \rho c^2} \quad (11)$$

Using a value of 29 million psi for $\rho c^2$ of steel, the thickness of the front mass can further be evaluated to be $$H = 3.16 \times 10^{-6}\ N\ K_L \quad (12)$$

Table 1 shows values of the front mass thickness H in inches for various load stiffness values of $K_L$, with values of the multiplier N as a parameter. To accent the meanings of N, a value of 2 specifies that, using the limiting values of side deflection shown above, the rock bit penetration is at least twice as great as the side-directed deflection, because side motions have been resisted by the mass reactance and rotary inertial reactance of the front mass. To place the values of $K_L$ in perspective, a rock bit that required a force of 30,000 pounds to penetrate 0.05-inch would have a value of $0.6 \times 10^6$ for $K_L$, and a rock bit that required a force of 60,000 pounds to penetrate 0.05-inch would have a value of $1.2 \times 10^6$ for $K_L$.

| $K_L \times 10^6$ | N, Bit Penetration Ratio 1 | 2 |
|---|---|---|
| .5 | 1.6 | 3.2 |
| .75 | 2.4 | 4.8 |
| 1.0 | 3.2 | 6.4 |
| 1.25 | 4.0 | 8.0 |

This table may therefore be used to determine the dimensions of a typical web frontal area. For wider kerfs, thicker webs are used. Also for stiffer (harder) rock formations it is desirable to use thicker webs or lower bit penetration ratios. In general the requisite mass may be determined using equation (9).

Consider also how side deflection of the bit is controlled during the interval between impulses. It can be shown that the same front mass selected to give small values of side deflection during the pulse interval will also be adequate to limit unwanted side deflections in the interval between pulses, taking account of the normal ratios of the forces, deflections and times likely to be encountered in a practical situation.

The side forces to be resisted during the interval between impact force pulses arise from the movement of the bit over a rough rock surface. Typical maximum values of amplitude are five times the bit bias force; typical maximum values of amplitude of duration are one-fifth the time interval between pulses. The use of an impact tool to fracture rock embodies relationships between other quantities as well. The indexing distance between impact blows is typically four times the bit penetration, the time between impact blows is typically more than eight times the impulse interval, and the impact force is typically more than 15 times the bit bias force. A number of relationships are illustrated in FIG. 12.

The relationship between the side bit deflection and the side force amplitude and duration is the same at all times, provided the values of force amplitude and duration are used that are appropriate to each time interval. Accordingly, using an expression to the form of equation (6), and since the mass operative during the pulse interval and interval between pulses is the same, then $$\frac{F_p \times t_p^2}{D_p} = \frac{F_I \times t_I^2,}{D_I} \quad (13)$$

which reduces to $$\frac{D_I}{D_p} = \frac{F_I\ t_I^2}{F_p\ t_p^2} \quad (14)$$

where $F$ = amplitude of the side force to be resisted
$t$ = duration of the side force to be resisted
$D$ = displacement of the bit due to the side force
$p$ is the subscript that refers to values during the impact pulse
$I$ is the subscript that refers to values during indexing, between pulses Substituting the relations between values of force and displacement given in the previous numerical examples, $$F_I = 5 \times 1/15 \times F_p,\ F_I / F_p = 1/3 \quad (15)$$

$$t_I = 1/5 \times 8 \times t_p,\ T_I^2 / t_p^2 = 64 / 25 \quad (16)$$

Then $$\frac{D_I}{D_p} = \frac{1}{3} \times \frac{64}{25} = \frac{64}{75} = .85 \quad (17)$$

Displacements ratios at least as great as 4 would be satisfactory, because of the relationship between indexing distance and bit penetration cited above. This means that force amplitudes or duration even greater than those used above would still be controlled by the frontal mass in the time interval between impact force pulses.

Figure 2:
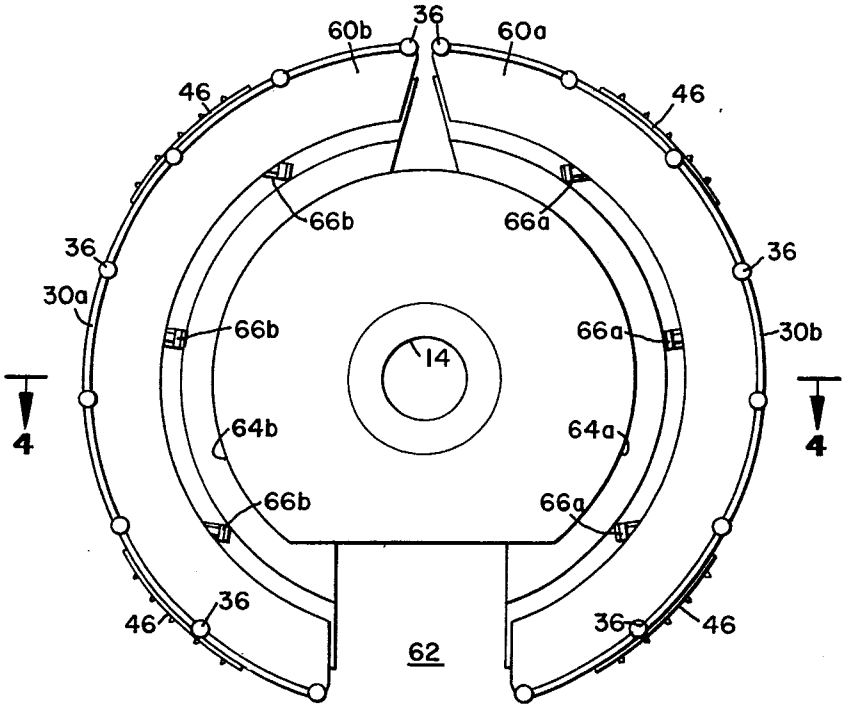
FIG. 2 is a right end view of the machine shown in FIG. 1.
Figure 4:
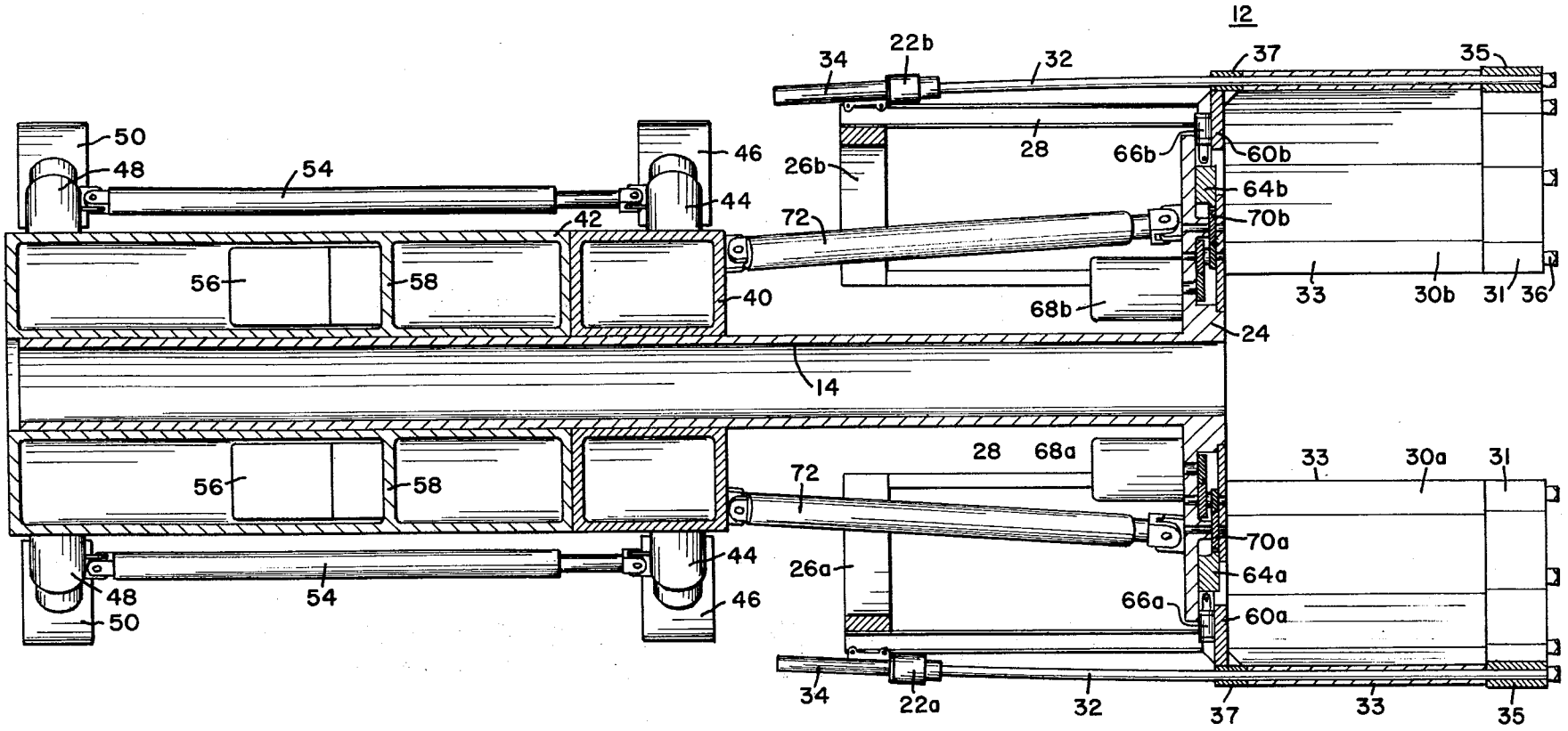
FIG. 4 is a sectional view of the machine shown in FIG. 1, the section being taken along the line 4—4 of FIG. 2.

The manner in which the machine may be steered in order to excavate the tunnel along its desired heading is as follows: First, consider that a kerf, say 10 feet in depth has been cut to define the wall of the tunnel and that the core remaining after the machine is retracted is removed by mechanical means and subsequent mucking. Then the drive motor 60*a* and 60*b* are rotated, the cutting unit is rotated so that the center of one of the webs 30*a* or 30*b* is aligned with the heading along which the tunnel is to be excavated. The machine is illustrated in FIG. 2 is steerable either to the right or to the left. Should it be desired to steer up or down, the hydraulic thrust cylinders 72 are disconnected from the forward propulsion unit element 40 and rotated so that either the web 30*b* or the web 30*a* are on the top and bottom walls of the tunnel, or vice versa. Then, one of the webs is retracted through the use of the hydraulic cylinders 66*a* or 66*b* and kerf cutting is commenced using only the web and its corresponding impact tools which have not been retracted. The kerf is cut a distance back from the face of the tunnel. The angle at which the kerf is cut is set by changing the relative position of the rear legs 48 and forward legs 44 so as to align the axis of the main shaft 14 along the new heading of the tunnel. With the cutting unit retracted to the desired point in the tunnel, kerf cutting is commenced using only the one of the webs 30*a* and 30*b* which has its drill bits in contact with the tunnel wall. Kerf cutting continues until the retracted impact tools and web strike the face of the tunnel. The cutting unit is again retracted and the muck between the new kerf and the remainder of the tunnel, removed. Then, the unit is advanced to the face of the tunnel, both webs are advanced radially to full kerf diameter, and a new kerf is cut to outline the tunnel along the new heading. By successive advancing and retracting of the webs with the cylinders 66, the unit may be steered to the heading desired. In this manner a tunnel having a 100 foot radius may be cut by steering the cutting unit approximately 6 inches for each 10 feet tunnel segment.

Referring to FIGS. 7 through 11, there is illustrated a tunneling machine having a propulsion unit 84 and a cutting unit 86. The propulsion unit 84 has forward and rear elements 90 and 92. The forward element 90 is disposed in telescoping relationship with the rear element 92. The forward element is attached to and movable with a main shaft 93. Thus, when hydraulic cylinders 89 and 91 are extended, the forward element 90 and the cutting unit 86 advance. By extending and retracting the forward element legs 94 and the rear element legs 96, hydraulic cylinders 125 connected between the legs 94 and 96 may be extended or retracted to advance the retract the tunneling machine in earth worm fashion. An operator station 99 is provided on the rear element 92 of the propulsion unit 90 and illustrates the relative size of the machine.

The cutting unit 86 has arcuate plates or disc portions 98*a* and 98*b* which provides a carriage for a group of impact tools 100*a* and its corresponding web 106*a* and another group of impact tools 100*b* and its corresponding web 106*b*, respectively. The drill steels 102 extend through the webs 106 which preferably have rear bearing arrangements 127 (see FIG. 10) and front bearings 129, which are preferably as shown in FIG. 16. Bits 104 are attached to the ends of the steels 102. The tools 100*a* and 100*b* have feed mechanisms 121, which are mounted on curved bars 103*a* and 103*b*, and are supported by linkages provided by a set of links 108*a* and 108*b*, and 110*a* and 110*b*. These links extend between a beam 107 mounted on a circular plate 101 at the forward end of the forward propulsion element 92 and the bars 103. Another set of links 112*a* and 112*b* and 114*a* and 114*b* mount the arcuate plate or disc portions 98*a* and 98*b* on the beam 107. Hydraulic cylinders 115*a* and 115*b* and 117*a* and 117*b* which are connected between a gusset 105 projecting from the plate 101 and the links 112*a* and 112*b* and 114*a* and 114*b* cause the plates 98*a* and 98*b* to advance or retract towards the axis of the machine. Such advance or retraction is permitted when braces 116*a* and 116*b* which maintain the webs 106*a* and 106*b* in the position shown in the drawing, are removed. Such retraction and advancement is used for steering and as well to position the impact drills in various positions to cut patterns of blast holes in the tunnel face as will be described in connection with FIG. 11.

For kerf cutting operations the circular plate 101 is rotated in oscillatory motion by a pair of drive motors 95 which rotate the main shaft 93 through a gear mechanism 97. Since the main shaft is connected to the plate 101, the entire cutting unit 86 rotates; the webs 106*a* and 106*b* providing dynamic control of the drill steels 102*a* and 102*b* and the bits 104 as was explained in connection with FIG. 1 through FIG. 6 and FIGS. 12 and 13. In this embodiment of the invention the hydraulic cylinders 89 and 91 advance (continuously or by being indexed between rotation cycles) the cutting unit 86 into the kerf while the unit is rotated by the motors 95 and gear mechanism 97 and the impact tools repeatedly apply impact blows upon the bottom of the kerf.

After the kerf is cut it may be desired to drill blast holes in the core which remains, the core being illustrated at 120 in FIG. 11. To this end, a plurality of pull-down mechanisms 119 are provided, one for each of the impact tools 100*a* and 100*b*. This pull-down mechanism may include a chain 121 driven by a feed motor 122 for advancing the actuator of the impact tool toward the arcuate plates 98*a* or 98*b*. The drill steel will then extend into the formation and drill a blast hole in the usual way. By removing the braces 116*a* and 116*b* and articulating the links 108, 110, 112 and 114, patterns of blast holes may be drilled to assist in core removal operations.

It is desirable to first cut the kerf and then retract the machine. Thereafter the blast holes can be drilled into the remaining core to facilitate breaking the core into chunks small enough for convenient mucking operation. Blast holes may be drilled one at a time or in groups. It is preferred that the impact tools be provided with rotation mechanisms in this embodiment of the invention.

Figure 17:
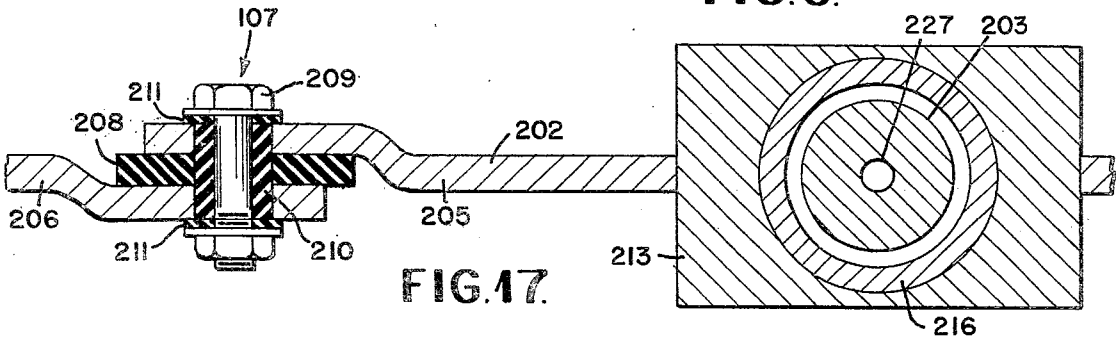
FIG. 17 is a view similar to FIG. 15 taken along the line 17—17 in FIG. 14.
Figure 7:
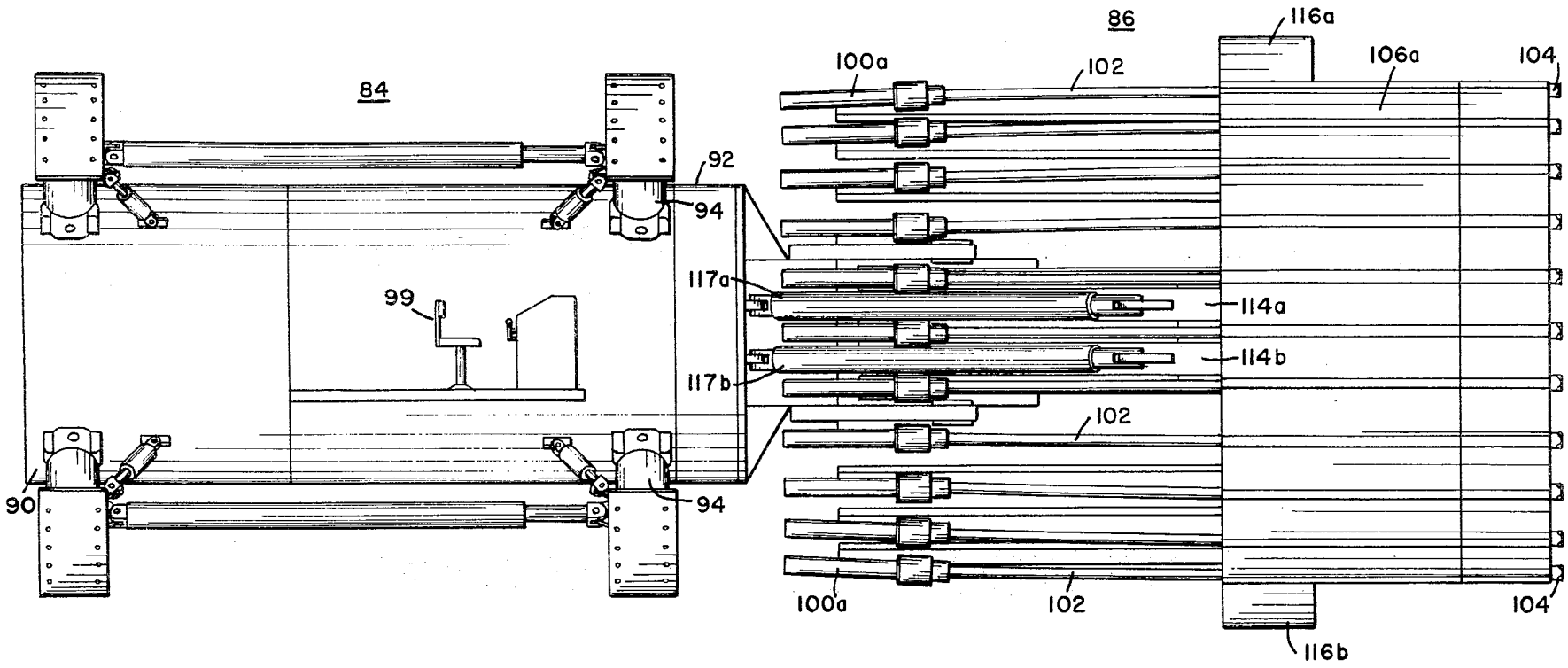
FIG. 7 is a front view of a tunneling machine in accordance with another embodiment of the invention.
Figure 9:
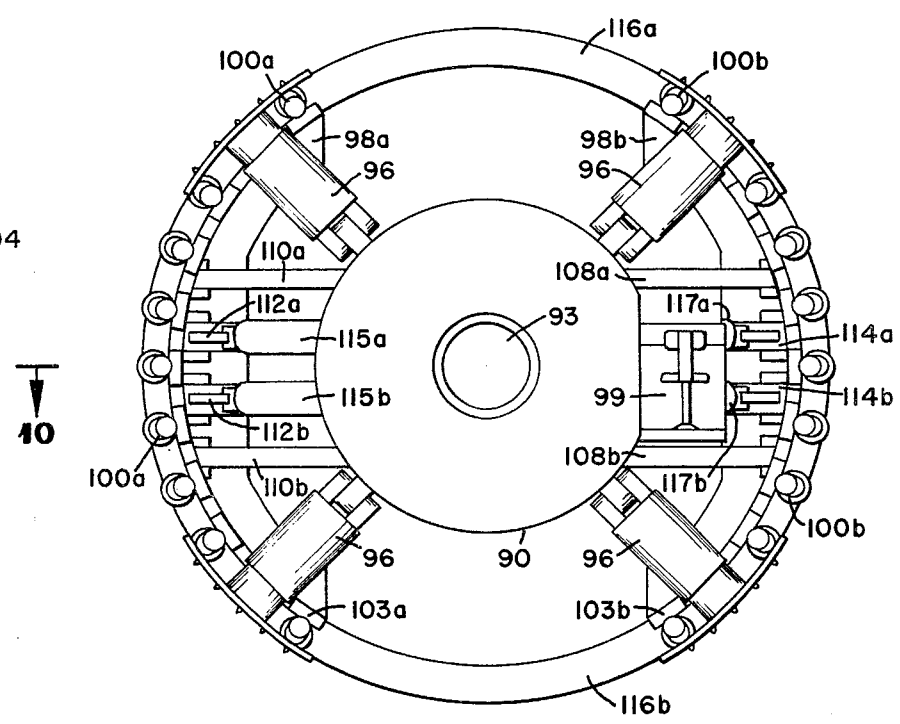
FIG. 9 is a left end view of the machine shown in FIG. 7.
Figure 8:
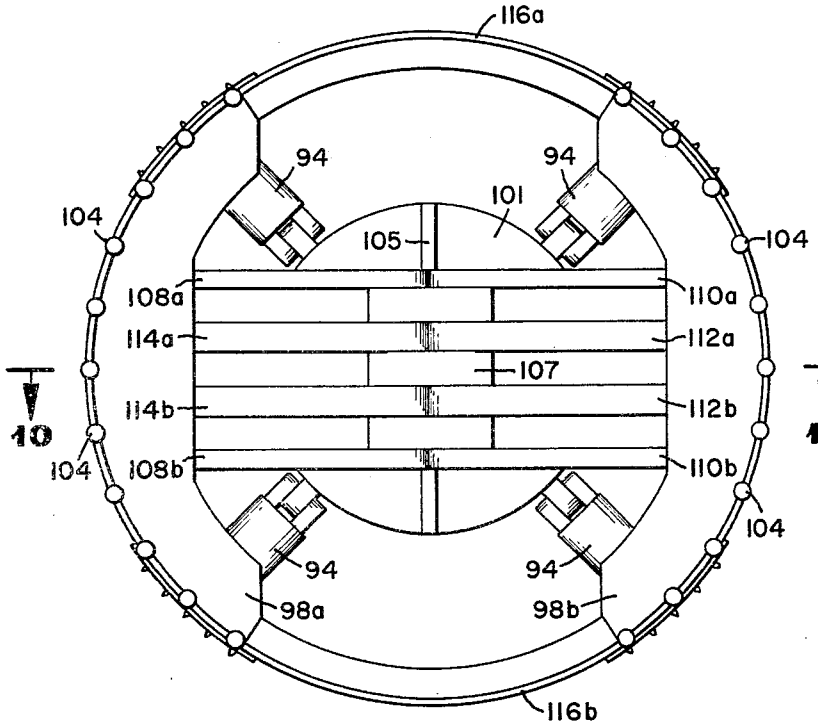
FIG. 8 is a right end view of the machine shown in FIG. 7.
Figure 10:
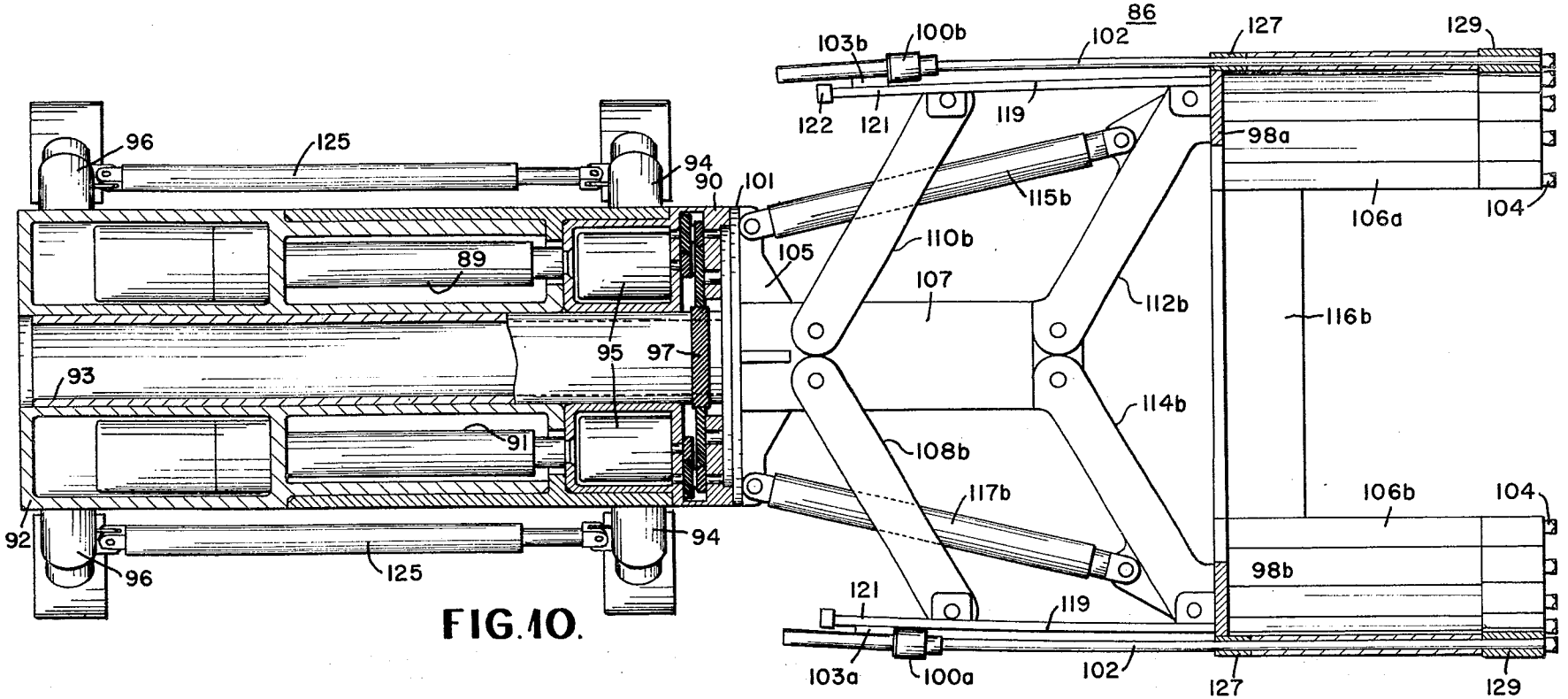
FIG. 10 is a sectional view of the machine shown in FIG. 7, the section being taken along the line 10—10 in FIG. 8.

FIGS. 14, 15 and 17 illustrate the webs and bearing arrangement which may be used in the machines illustrated in FIGS. 1 to 11. The web 200 has a frontal mass section 201 and a rear section 202. The length of the frontal section 201 in the direction of the axis of the drill steel 203 is preferably designed as described above in connection with FIG. 13. In a typical application the length may be about 18 inches. The rear section 202 provides principally for alignment guidance and support of the steel 203 in the kerf. Accordingly, to reduce the weight of the web, the rear section may be of lesser thickness than the front section 201. Steps 204 are therefore formed between the sections. The difference in thickness may be observed by comparing FIG. 15 which shows the front section 201 thickness, with FIG. 17 which shows the rear section thickness.

The webs are preferably provided in the form of segments 205, 206 individual to each drill steel 203. Each segment is isolated from the other by an overlap joint 207. The joint includes a slab 208 of isolating material which may be Z shaped in the front section (see FIG. 15). An elastomeric isolating material such as soft rubber is suitable. The segments are coupled by nuts and bolts 209 which are isolated from the webs themselves by sleeves 210 and washers 211 of the same material as the slabs 208.

The drill steels 203 extend through bores 212 in bushing portions 213 which run the length of the web 200. The edges of the bushings in the front section 201 may have carbide inserts 214 which can assist in breaking material (e.g. rocks) which fall into the kerf.

A front bearing 215 and a rear bearing 216 are provided at the front of the front web section 201 and the back of the rear web section 202 respectively. The rear bushing 216 is provided by a sleeve 217 having seals 218 (illustrated as chevron seals) at its ends to define a space which is preferably packed with grease.

The rear bearing also is provided by a sleeve 220 having chevron seals 221 at each end. A pressure lubricated bearing is formed by a lubricant (grease) filled reservoir 222 which is filled with pressurized lubricant through a fitting 223 which extends through the steps 204. Pressure is maintained by a spring 224 connects the space around the steel 203 between the seals 221 with the reservoir.

The steel 203 and the bit 229 has a hole 227 for air or liquid to flush cuttings from the bottom of the kerf.

FIG. 16 illustrates a bearing arrangement 230 which is connected by couplings 231 and 232 between the steel 233 and the bit 234. The steel is shown extending out of the web 235 as is the case when the machine is used for drilling, say after kerfing, as was discussed in connection with FIG. 11. The bore 236 in the web through which the steel extends has an enlarged portion 237 at the front end of the web. The bearing 230 enters this enlarged portion and remains therein against the step 238 during kerfing.

The bearing consists of a sleeve 239 disposed between two spaced discs, 240 and 241. A sleeve 261 of bearing material, such as bronze, is disposed between the discs 240 and 241. Spaces confined between chevron seals 242 and 243 and the sleeve 261 are packed with grease. The bearings 230 afford the front bearing steels in the web 235.

From the foregoing description it will be apparent that improved apparatus for kerfing and tunneling has been provided. While two embodiments of tunneling machines incorporating the invention have been described for purposes of illustrating the invention, it will be appreciated that variations and modifications thereof as well as other applications for the invention and within the scope thereof will present themselves to those skilled in the art. Accordingly, the foregoing description should be taken as illustrative and not in any limiting sense.

What is claimed is:

1. Apparatus for cutting a kerf in an earth formation which comprises an impact tool having an actuator coupled to a drill steel which receives a bit at the end thereof, said bit delivering impact energy in the form of force pulses to said formation;

a carriage supporting said actuator and being movable in directions toward and across said formation;

a web member having a shape which outlines said kerf, said web member having a mass and stiffness substantially greater than the mass and stiffness of said drill steel, said web being supported by said carriage and movable therewith into and along said kerf, the thickness of said web member being less than the width of the cross section of said bit in the direction across said kerf, said web member extending longitudinally from said carriage a substantial length along said drill steel up to a location immediately behind said bit, said web member having an opening extending completely therethrough from the front end of said web member which faces said formation and the rear end of said web member which faces said actuator, front and rear bearings in said opening, said front bearing being disposed at said web member front end and said rear bearing being disposed at said web member rear end, said drill steel extending through said opening in said web member and penetrating said member and being in juxtaposition therewith along said substantial length so as to be in closely coupled relationship therewith, said drill steel being supported in said front and rear bearings, and said web member supporting and guiding said drill steel into and along said kerf.

2. The invention as set forth in claim 1 wherein said member is substantially as long as the depth of said kerf.

3. The invention as set forth in claim 1 wherein said actuator is spaced from said member and a first section of said drill steel is disposed in said member and a second section of said drill steel is disposed between said member and said actuator, said second section being adapted to bend when the axis of said actuator and said member are not in alignment.

4. The invention as set forth in claim 3 wherein said member is adapted to be disposed adjacent a wall of said formation, said actuator being spaced laterally from said member so as to clear said wall, and said second section of said steel being maintained in the bent position by said member.

5. The invention as set forth in claim 1 wherein said member has substantial mass in the vicinity of said steel which is disposed behind said bit for dynamically controlling the motion of said bit.

6. The invention as set forth in claim 5 wherein the mass of said member is proportional to the stiffness of the formation penetrated by said bit on each impact.

7. The invention as set forth in claim 1 wherein said web member has at its forward end a frontal portion presenting said mass and provides inertial reactance sufficient to control the deflection of said bit while said kerf is being cut.

8. The invention as set forth in claim 7 wherein said frontal portion mass is equal to $$\frac{4\pi K_L}{\omega_p^2}$$

where $K_L$ is the stiffness of the formation and $\omega_p$ is the angular frequency of said force pulses.

9. The invention as set forth in claim 1 wherein said moving means includes means for oscillating said carriage back and forth in lateral directions across said formation to move said bit sideways along said kerf.

10. The invention as set forth in claim 9 wherein said oscillating means is operative to provide said sideways motion over a distance greater than the penetration of said bit into said formation upon each impact thereof against said formation.

11. The invention as set forth in claim 1 including a plurality of said drill steels, a plurality of said impact tools each for driving into said formation a separate one of said drill steels, said drill steels being laterally spaced from each other along said web, said web having a plurality of segments each individual to a different one of said steels, said steels each extending through and penetrating a different one of said segments, joints coupling said segments together, and damping members in said joints isolating said segments from each other.

12. The invention as set forth in claim 1 wherein said web has a frontal section and a rear section defining a step therebetween, said front bearing being disposed in said frontal section and said rear bearing being disposed in said rear section, and said frontal section being thicker than said rear section.

13. In a tunneling machine, a rotatable annular carriage movable into a tunnel, a web member having a generally annular shape which outlines the wall of the tunnel, said member being mounted on the forward side of said carriage and along the wall of said tunnel toward the face of said tunnel, said web member having a plurality of openings extending in an axial direction therethrough and spaced from each other in a lateral direction around said web member, a plurality of impact tools mounted on the rearward side of said carriage, said tools being spaced laterally from each other around the wall of the tunnel, said web member having front and rear bearings in each of said plurality of openings therethrough, each of said tools having a separate drill steel, a substantial length of which is disposed in and extends through said web member by extending through said openings therethrough, said drill steels being supported in said front and rear bearings, said web member having a substantial mass and a stiffness much greater than the stiffness of said drill steels, said web member and each said drill steel being in juxtaposition with each other along said substantial length so as to be in closely coupled relationship for movement in a direction around the wall of the tunnel, drill bits on the ends of said steels which protrude through the forward end of said web member, and the thickness of said web member being less than the cross sectional dimension of said drill bits.

14. The invention as set forth in claim 13 wherein said web is a segmental portion of a ring, and has a plurality of longitudinal holes therethrough, said holes being circumferentially spaced and receiving different ones of said drill steels.

15. The invention as set forth in claim 13 wherein said web has at its forward end frontal portions in the vicinity of each of said bits having a predetermined mass for controlling deflection of said bits.

16. The invention as set forth in claim 13 wherein a plurality of said webs is provided and said impact tools are arranged in a circular pattern in a plurality of groups each opposite a different one of said webs, the drill steels of the group of tools extending through the one of said plurality of webs disposed opposite thereto.

17. The invention as set forth in claim 16 wherein drive means are provided for oscillating each group of tools and the one of said plurality of webs along separate arcs.

18. The invention as set forth in claim 17 wherein means are included in said oscillating means for oscillating adjacent groups of said webs and the tools opposite thereto in opposite senses so that they are contrarotatable toward and away from each other.

19. The invention as set forth in claim 16 wherein means are provided for separately retracting each of said webs and the group of tools opposite thereto in a direction away from the wall of the tunnel.

20. The invention as set forth in claim 13 wherein said impact tools each have an actuator which applies percussive energy to the drill steel thereof, the longitudinal axis of said actuators of said tools being displaced in a radial direction away from the tunnel wall from the longitudinal axis of the sections of said drill steels disposed in said web, said actuators thereby clearing the tunnel wall and the sections of said drill steels between said actuators and said web being bent.

21. The invention as set forth in claim 13 wherein pull-down means are mounted on said carriage each for feeding a separate one of said impact tools in a forward direction whereby to drill separate holes in said tunnel face when said pull-down means are operated.

22. A tunneling machine which comprises propulsion means movable into and along the tunnel, means mounted on the forward end of said propulsion means for cutting a kerf outlining the wall of the tunnel, said cutting means including a rotatable carriage, a web mounted on the forward side of said carriage and extending into and along the kerf, said web having a shape which outlines the wall of the tunnel, said web having a plurality of holes therethrough between the forward end thereof which extends into said kerf and the rearward end thereof which faces said carriage, said openings being spaced laterally from each other around said web, front and rear bearings respectively disposed in the forward and rearward ends of said openings, a plurality of impact tools mounted in laterally-spaced relationship around the wall of the tunnel on the rear side of said carriage, each of said tools having a separate drill steel which penetrates said web through a different one of said openings and is supported in said front and rear bearings therein, whereby said web is supported along a substantial length of said web where said steel and said web are juxtaposed and are in closely coupled relationship with each other for movement along said kerf, said web having a substantial mass and a stiffness which is much greater than the stiffness of said drill steels, a separate bit on the end of each said steel which extends through the forward end of said web, said web having a thickness less than the diameter of said bit.

23. The invention as set forth in claim 22 wherein said propulsion means comprises a structure having a plurality of forward legs and a plurality of rear legs disposed in diametrically opposite pairs for gripping the wall of the tunnel when extended, and means for selectively extending and retracting said legs for steering said machine along different tunnel headings.

24. The invention as set forth in claim 23, further comprising a main beam, the rear end of said beam being supported in said propulsion means, and the forward end of said beam carrying said carriage, said propulsion means having forward and rearward structural elements, said forward structural elements being connected to said forward legs and said rearward structural elements being connected to said legs, said forward structural element being movably mounted on said beam, and means for separating and retracting said forward and rearward structural elements to propel said machine in steps forwardly or rearwardly along the tunnel.

25. The invention as set forth in claim 24 wherein said carriage includes a disc-shaped member mounted adjacent the forward end of said beam, said web comprising a plurality of segmental portions of a hollow cylinder arranged diametrically opposite each other with their outer walls extending from the region of the outer periphery of said disc, a frame mounted on rear side of said disc, said impact tools being mounted on said frame.

26. The invention as set forth in claim 25 wherein said disc has a plurality of radially movable portions each corresponding to a different web portion and having its corresponding web portion mounted thereon, said frame upon which said impact tools are mounted also having a plurality of parts each corresponding to a different web portion and mounted on the disc part for the web portion to which it corresponds, and means for steering said cutting means including means for selectively retracting different ones of said disc portions away from the tunnel wall.

27. The invention as set forth in claim 26 wherein said retracting means includes a plurality of links pivotally connected to said main beam and to said disc portions, and means for articulating said links.

28. The invention as set forth in claim 26 wherein said retracting means includes a plurality of segmental ring gears mounted on a central portion of said disc, a plurality of ring segments which provide said disc portions, said ring segments being coupled to said ring gears for rotation therewith and being slidably mounted on said central portion of said disc in a radial direction, and hydraulic cylinders reacting against said central portion of said disc and coupled to said ring segments for retracting and extending said ring segments in a radial direction.

29. The invention as set forth in claim 28 including drive means mounted on said central portion of said disc for rotating said ring gear oscillatory in clockwise and counter clockwise directions.

30. The invention as set forth in claim 25 wherein said disc-shaped member is coupled to said forward structural element, said forward structural element being movable with said beam means for advancing and retracting said beam to move said cutting means into and out of said kerf, and means for rotating said forward structural elements to provide sideways movement of said bits along said kerf.

31. The invention as set forth in claim 25 wherein said disc-shaped member is centrally connected to said main beam at the forward end thereof, means for extending and retracting said disc-shaped member and said beam to advance and retract said cutting means into and out of said kerf, and drive means in said disc-shaped member for rotating said web, said frame aand said impact tools to provide sideways cutting of said kerf.

32. The invention as set forth in claim 22 wherein said carriage includes a pair of arcuate plates, said webs being mounted on forward periphery of said plates, a rotatable plate mounted on the forward end of said propulsion means, a shaft extending forwardly from said plate, a first plurality of links pivotally mounted on said shaft at one end thereof and supporting said tools at the opposite end thereof, a second plurality of links pivotally mounted on said shaft at one end thereof and to said plates at the opposite end thereof, and a plurality of members extending between said rotatable plate and said second plurality of links and extendable and retractable for extending and retracting said arcuate segments and said web.

* * * * *